US005775413A

United States Patent [19]

Kawanabe et al.

[11] Patent Number: 5,775,413

[45] Date of Patent: Jul. 7, 1998

[54] HEAT EXCHANGER HAVING CORRUGATED FINS AND AIR CONDITIONER HAVING THE SAME

[75] Inventors: Takashi Kawanabe; Hideaki Mukaida; Masanori Gotoh; Yoshinori Tohya, all of Ohizumimachi; Masahiro Kobayashi; Atuyumi Ishikawa, both of Ohta; Yoshitaka Hara, Ohra-gun, all of Japan

[73] Assignee: Sanyo Electric Co., Ltd., Osaka, Japan

[21] Appl. No.: 653,303

[22] Filed: May 24, 1996

[30] Foreign Application Priority Data

| | | | |
|---|---|---|---|
| Sep. 14, 1995 | [JP] | Japan | 7-262534 |
| Oct. 11, 1995 | [JP] | Japan | 7-289301 |
| Oct. 18, 1995 | [JP] | Japan | 7-294830 |

[51] Int. Cl.[6] ..... F28D 1/053

[52] U.S. Cl. ..... 165/151; 165/181

[58] Field of Search ..... 165/150, 151, 165/181

[56] References Cited

U.S. PATENT DOCUMENTS

| | | | |
|---|---|---|---|
| 4,705,105 | 11/1987 | Cur | 165/151 |
| 5,203,403 | 4/1993 | Yokoyama et al. | 165/151 |

FOREIGN PATENT DOCUMENTS

| | | | |
|---|---|---|---|
| 93596 | 1/1963 | Japan . | |
| 179894 | 7/1989 | Japan | 165/151 |
| 01256795 | 10/1989 | Japan . | |
| 01266494 | 10/1989 | Japan . | |
| 44191 | 2/1990 | Japan | 165/151 |
| 75897 | 3/1990 | Japan | 165/151 |

*Primary Examiner*—Leonard R. Leo
*Attorney, Agent, or Firm*—Darby & Darby

[57] ABSTRACT

In a heat exchanger comprising a number of multilayered fins, and a refrigerant pipe arranged in the meandering form in the fins, and an air conditioner having the heat exchanger, each of the fins has a corrugated portion formed in an air-flow direction thereon, which has at least two wavelike portions for producing a turbulent flow of air having such strength that a temperature boundary layer of the air is broken, but resistance against to the air flow is not excessively high. Each wavelike portion may be designed to have a triangular section or a trapezoidal section, and a flat portion may be disposed between the wavelike portions.

2 Claims, 13 Drawing Sheets

HEAT EXCHANGER HAVING CORRUGATED FINS AND AIR CONDITIONER HAVING THE SAME

BACKGROUND OF THE INVENTION

1. Field of the Invention

The present invention relates to a heat exchanger comprising a number of fins which are arranged in a multilayer structure, and a refrigerant pipe which is inserted in the multilayered fins so as to be extended in a meandering form, and an air conditioner having the heat exchanger.

2. Description of Related Art

In a conventional heat-pump type air conditioner, during cooling operation refrigerant is circulated through a compressor, a heat exchanger at a heat source side (outdoor side), a four-way change-over valve, a flow-amount control valve (expansion device), a heat exchanger at a user side (indoor side), and the four-way change-over valve in this order during cooling operation, and during heating operation the refrigerant is also circulated in the opposite direction to that of the cooling operation. The heat exchanger at the heat source side serves as an evaporator in heating operation, and as a condenser in cooling operation.

In order to enhance the heat exchange efficiency of such a heat exchanger, various proposals on the shape of fins have been made. For example, there has been known a fin on which two projecting portions each having a triangular shape in section are continuously formed in an air flow (blow) direction (in the thickness direction of the fin).

However, the conventional fin as described above has a problem that a sufficient turbulent flow of air to promote thermal diffusion cannot be established on the surface of the fin when the air flows through the fin while heat-exchanged by the refrigerant pipe, and thus a thermal boundary layer of the air still remains, so that the heat exchange efficiency is insufficient.

In view of the foregoing problem, it may be considered that a large number of projections are randomly formed on a fin to promote occurrence of the turbulent flow of the air passing over the surface of the fin. In this case, however, such a random arrangement of the projections causes increase of resistance to the air flow, and thus it rather reduces the heat exchange efficiency.

In addition, the conventional air conditioner as described above has used a chemical compound such as R-12 or R-50 as refrigerant to be filled in a refrigerant circuit. However, such chemical compounds have potentiality of breaking the ozone layer in the sky because they have chlorine groups therein. Therefore, for the purpose of the protection of environment, R-11 (chlorodifluorometane) having little chlorine group, chemical components, such as R-32 (difluorometane), R-125 (pentafluoroethane) and R-134a (tetraf luoroethane) which have no chlorine group, or a mixture of these compounds (hereinafter referred to as "HFC-based refrigerant (mixture refrigerant)") have been recently used as substitutive refrigerant. When such an HFC-based refrigerant is used as refrigerant, the refrigerant circuit is necessarily kept under high-pressure and high-temperature state due to the inherent characteristic of the mixture refrigerant. In order to prevent the refrigerant circuit to fall into an abnormal high-pressure and high-temperature state, the heat exchanger has been required to have higher heat exchange efficiency.

SUMMARY OF THE INVENTION

An object of the present invention is to provide a heat exchanger which can enhance its heat exchange efficiency, and an air conditioner having the heat exchanger.

According to a first aspect of the present invention, a heat exchanger comprising a number of fins which are arranged in a multilayer structure, and a refrigerant pipe which is inserted in the multilayered fins so as to be arranged in a meandering form, the heat exchanger performing heat exchange between air and refrigerant to perform cooling and/or heating operation, is characterized in that each of the fins has a corrugated portion formed in an air-flow direction thereon, the corrugated portion having at least two wavelike portions for producing a turbulent flow of air having such strength that a temperature boundary layer of the air is broken, but resistance against to the air flow is not excessively high.

In the heat exchanger of the first aspect of the present invention, the corrugated portion may comprise three wavelike portions which are formed in the air flow direction on each of the fins, each wavelike portion having a substantially triangular section.

According to the heat exchanger as described above, since the three wavelike portions are formed along the air flow direction on the fin of the heat exchanger, a turbulent flow enough to break the temperature boundary layer can be formed, resulting in enhancement of the heat exchange efficiency. In addition, the turbulent flow thus formed does not excessively increase its resistance to the air flow, and thus the pressure loss is not increased. Therefore, the heat exchange efficiency of the whole heat exchanger can be enhanced.

In the heat exchanger as described above, the width of each of the fins is set to two to three times of the pipe diameter of the refrigerant pipe, the width of each wavelike portion is set to substantially trisection the fin width, and the height of said wavelike portion is set to one-seventh to one-eighth of the width of said wavelike portion.

According to the heat exchanger as described above, since the fin width is set to two to three times of the pipe diameter of the refrigerant pipe, the fin width can be minimized while the heat exchange efficiency based on the temperature difference between the air and the fin in the heat exchange is maximized. That is, if the fin width is less than the double of the pipe diameter of the refrigerant pipe, a sufficient heat exchange area cannot be obtained. On the other hand, if the fin width is more than the three times of the pipe diameter of the refrigerant pipe, the fin width is excessively large irrespective of a small temperature difference between the air and the fin.

Further, according to the heat exchanger as described above, the width of the wavelike portion is set to substantially trisectioning the fin width (i.e., the width of the wavelike portion is substantially equal to one-third of the fin width), and the height of the wavelike portion is set to one-seventh to one-eighth of the width thereof. Accordingly, there can be produced a turbulent flow of air with which the temperature boundary layer of the air is broken, but resistance against to the air flow can be minimized.

In the heat exchanger of the first aspect of the present invention, the corrugated portion may comprise two wavelike portions which are formed in the air flow direction on each of the fins, and a flat portion interposed between the wavelike portions, each of the trapezoidal wavelike portions having a triangular section.

According to the heat exchanger as described above, the corrugated portion comprises the two wavelike portions, and the flat portion interposed between the wavelike portions, so that a turbulent flow enough to break the temperature boundary layer of the air can be produced in air flowing along the surface of the fins, so that a heat exchange efficiency can be enhanced. In addition, the resistance to the flowing air is not excessively large. Therefore, the heat exchange efficiency of the whole heat exchange can be enhanced.

Further, the flat portion of each in itself enhances a drainage effect to prevent the surface of the fin from being frosted. For example, when the heat exchanger as described above is used as an outdoor heat exchanger, defrosting operation can be effectively performed because the outdoor heat exchanger has an excellent drainage effect, and an effect of the latent heat of water on the outdoor heat exchanger can be suppressed. Therefore, even when the defrosting operation is switched off to return to heating operation, the heat exchanger efficiency can be kept to a high level.

In the heat exchanger as described above, the width of each of the fins is set to two to three times of the pipe diameter of the refrigerant pipe, the width of the flat portion is set to a half of the width of the wavelike portion, and the height of the wavelike portion is set to one-eighth to one-ninth of the width of the wavelike portion.

According to the heat exchanger as described above, since the fin width is set to two to three times of the pipe diameter of the refrigerant pipe, the fin width can be minimized while the heat exchange efficiency based on the temperature difference between the air and the fin in the heat exchange is maximized. That is, if the fin width is less than the double of the pipe diameter of the refrigerant pipe, a sufficient heat exchange area cannot be obtained. On the other hand, if the fin width is more than the three times of the pipe diameter of the refrigerant pipe, the fin width is excessively large irrespective of a small temperature difference between the air and the fin.

According to the heat exchanger as described above, the width of the flat portion is set to the half of the width of the wavelike portion, and the height of the wavelike portion is set to one-eighth to one-ninth of the width of the wavelike portion. Therefore, the air flowing along the fins forms a turbulent flow enough to break the temperature boundary layer, however, the resistance to the air flow can be minimized.

In the heat exchanger of the first aspect of the present invention, the corrugated portion may comprise two trapezoidal wavelike portions which are formed in the air flow direction on each of the fins, and a flat portion interposed between the trapezoidal wavelike portions, each of the trapezoidal wavelike portions having a substantially trapezoidal section.

According to the heat exchanger as described above, on each fin are formed two trapezoidal wavelike portions and a flat portion interposed therebetween in the air flow direction, whereby a turbulent flow enough to break the temperature boundary layer of the air can be produced in air flowing along the surface of the fins to thereby enhance a heat exchange efficiency. In addition, the resistance to the flowing air is not excessively large. Therefore, the heat exchange efficiency of the whole heat exchange can be enhanced. In addition, the trapezoidal wavelike portion has an upper flat portion, and both the upper flat portion and the flat portion between the trapezoidal wavelike portions serve to enhance the drainage effect. Therefore, the frosting on the fins can be prevented more excellently.

In the heat exchanger as described above, the width of each of the fins is set to two to three times of the pipe diameter of said refrigerant pipe, the ratio of the width of the flat portion to the width of the trapezoidal wavelike portion is set to ⅓, and the height of the trapezoidal wavelike portion is set to one-fourth to one-fifth of the width of the trapezoidal wavelike portion.

According to the heat exchanger as described above, since the fin width is set to two to three times of the pipe diameter of the refrigerant pipe, the fin width can be minimized while the heat exchanges efficiency based on the temperature difference between the air and the fin in the heat exchange is maximized. That is, if the fin width is less than the double of the pipe diameter of the refrigerant pipe, a sufficient heat exchange area cannot be obtained. On the other hand, if the fin width is more than the three times of the pipe diameter of the refrigerant pipe, the fin width is excessively large irrespective of a small temperature difference between the air and the fin.

Further, according to the heat exchanger as described above, the ratio of the width of the flat portion to the width of the trapezoidal wavelike portion is set to ⅓, and the height of the trapezoidal wavelike portion is set to one-fourth to one-fifth of the width of the trapezoidal wavelike portion. Therefore, the air flowing along the fins forms a turbulent flow enough to break the temperature boundary layer, however, the resistance to the air flow can be minimized.

According to a second aspect of the present invention, an air conditioner in which refrigerant is circulated in a refrigerant circuit comprising a compressor, a user-side heat exchanger, an expansion device and a heat-source side heat exchanger, is characterized in that at least one of the user-side heat exchanger and the heat-source side heat exchanger comprises a number of fins which are arranged in a multilayer structure, and a refrigerant pipe which is inserted in the multilayered fins so as to be arranged in a meandering form, and each of the fins has a corrugated portion formed in an air-flow direction thereon, the corrugated portion having at least two wavelike portions for producing a turbulent flow of air having such strength that a temperature boundary layer of the air is broken, but resistance against to the air flow is not excessively high.

In the air conditioner of the second aspect of the present invention, the corrugated portion may comprises three wavelike portions which are formed in the air flow direction on each of the fins, each wavelike portion having a triangular section.

In the air conditioner of the second aspect of the present invention, the corrugated portion may comprise two wavelike portions which are formed in the air flow direction on each of said fins, and a flat portion interposed between the wavelike portions, each of the trapezoidal wavelike portions having a triangular section.

In the air conditioner of the second aspect of the present invention, the corrugated portion may comprise two trapezoidal wavelike portions which are formed in the air flow direction on each of the fins, and a flat portion interposed between the trapezoidal wavelike portions, each of the trapezoidal wavelike portions having a trapezoidal section.

According to the air conditioner as described above, the heat exchange efficiency can be enhanced, and thus the air-conditioning power can be also enhanced by the special structure of the fins of the heat exchanger used in the air conditioner. Further, HFC-based refrigerant which necessarily keeps the refrigerant circuit under high-pressure and high-temperature state can be used as refrigerant.

DETAILED DESCRIPTION OF THE PREFERRED EMBODIMENTS

Preferred embodiments according to the present invention will be described with reference to the accompanying drawings.

Figure 1:
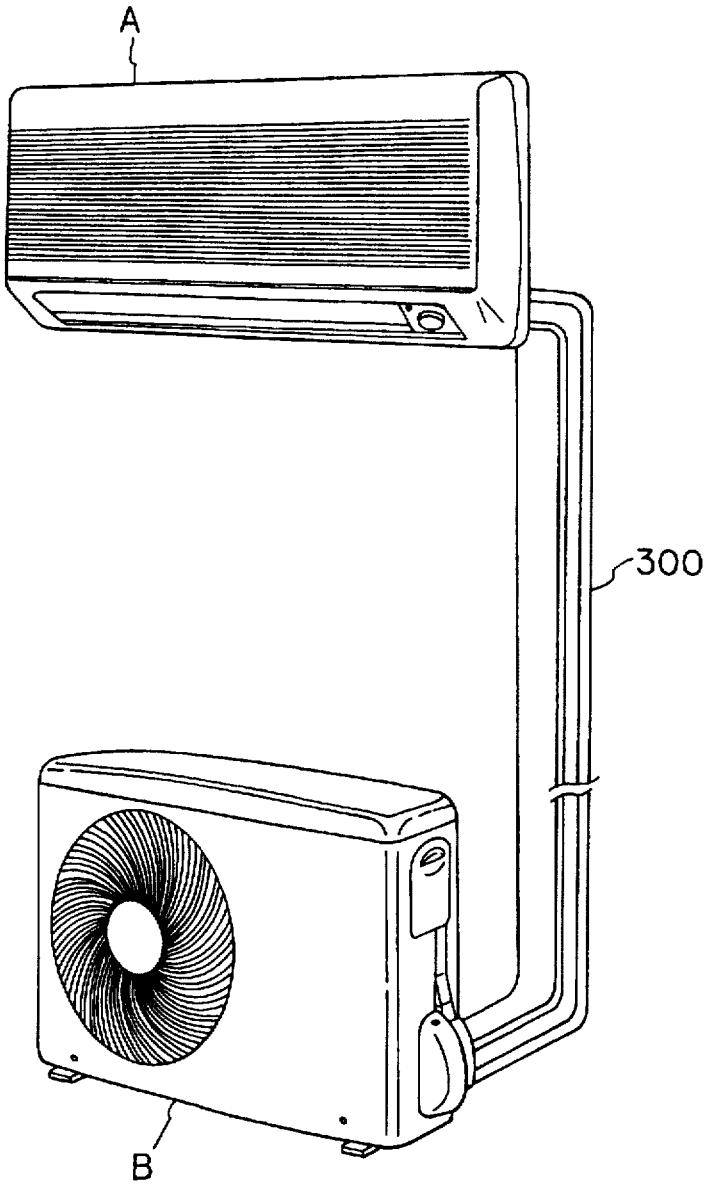
FIG. 1 is a schematic diagram showing an air conditioner according to the present invention.
Figure 2:
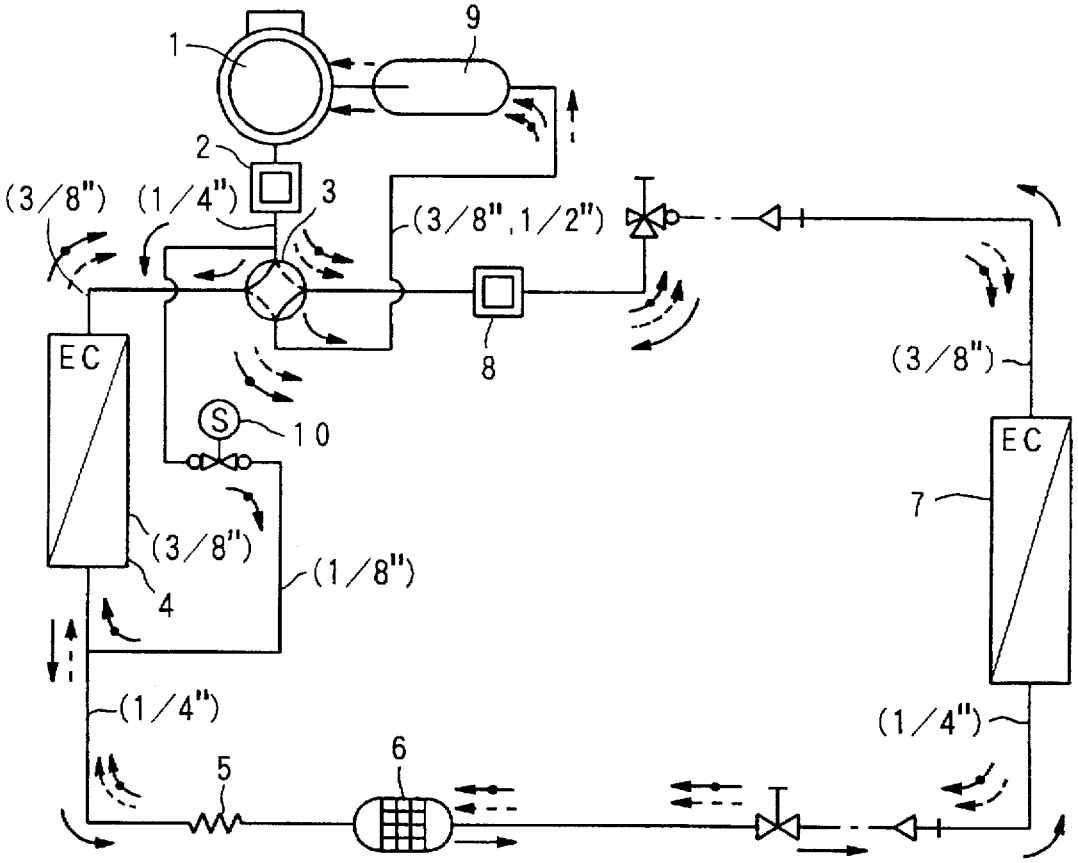
FIG. 2 is a refrigerant circuit of the air conditioner shown in FIG. 1.

FIG. 1 is a perspective view showing a general domestic air conditioner. This type of air conditioner comprises an user side unit (indoor unit) A which is disposed indoors, and a heat source side unit (outdoor unit) B which is disposed outdoors, and both the indoor unit A and the outdoor unit B are connected to each other through a refrigerant pipe 300. FIG. 2 is a refrigerant circuit diagram showing the refrigeration cycle of the air conditioner shown in FIG. 1.

As shown in FIG. 2, the refrigerant circuit includes a compressor 1 comprising a motor portion and a compressing portion which is driven by the motor portion, a muffler for suppressing vibration and noises due to pulsation of refrigerant discharged from the compressor 1, a four-way change-over valve 3 for switching refrigerant flow in cooling/heating operation, a heat exchanger at the heat source side (outdoor heat exchanger) 4, a capillary tube (expansion device) 5, a screen filter (strainer) 6, a heat exchanger at an user side (indoor heat exchanger) 7, a muffler 8, an accumulator 9 and an electromagnetic open/close valve 10.

In FIG. 2, the flow direction of the refrigerant discharged from the compressor is selectively determined on the basis of one of three modes (a cooling operation mode as indicated by a solid-line arrow, a heating operation mode as indicated by a dotted-line arrow and a defrosting operation mode as indicated by a solid-line arrow with a dot in accordance with the switching position of the four-way change-over valve 3 and the electromagnetic open/close valve 10

In cooling operation, the outdoor heat exchanger 4 serves as a condenser, and the indoor heat exchanger 7 serves as an evaporator. On the other hand, in heating operation, the indoor heat exchanger 7 serves as a condenser, and the outdoor heat exchanger 4 serves as an evaporator. In defrosting operation (under heating operation), a part of the refrigerant discharged from the compressor 1 is directly supplied to the outdoor heat exchanger 4 to increase the temperature of the outdoor heat exchanger 4, whereby the temperature of the outdoor heat exchanger is increased to defrost the frosted outdoor heat exchanger. If the defrosting operation as described above does not work effectively (when the outside temperature is very low, for example), the defrosting is forcedly performed by an inverse cycle defrosting operation (the refrigerant flows in the direction as indicated by the solid-line arrow).

Figure 3:
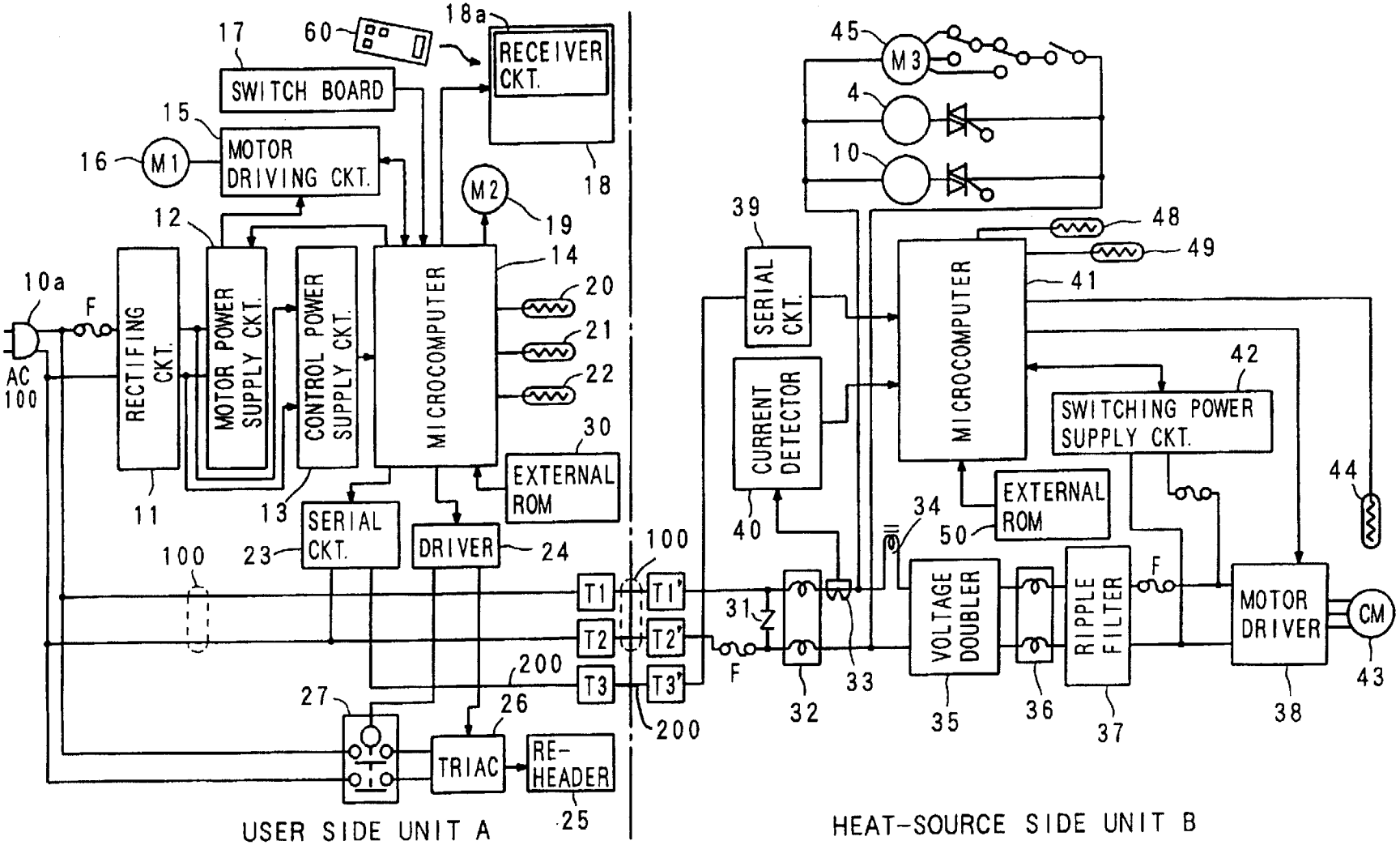
FIG. 3 is a diagram showing a control circuit for the refrigerant circuit shown in FIG. 2.

FIG. 3 is a diagram showing a control circuit for the air conditioner of the present invention. The circuit diagram of FIG. 3 is mainly divided into two diagrams at right and left sides with respect to a one-dotted line at the center thereof. The left side diagram shows a control circuit for the indoor unit A (hereinafter referred to as "indoor control circuit"), and the right side diagram shows a control circuit for the outdoor unit B (hereinafter referred to as "outdoor control circuit"). Both the indoor and outdoor control circuits are connected to each other through a driving line 100 and a control line 200.

The indoor control circuit for the indoor unit A comprises a rectifying circuit 11, a motor power supply circuit 12, a control power supply circuit 13, a motor driving circuit 15, a switch board 17, a reception circuit **18*a*, a display board 18 and a flap motor 19**.

The rectifying circuit 11 rectifies an alternating voltage of 100V which is supplied from a plug **10*a*. The motor power supply circuit 12 regulates a DC voltage supplied to a DC fan motor 16 to a voltage of 10 to 36V, and the DC fan motor 16 blows heat-exchanged (cooled or heated) air into a room to be air-conditioned in accordance with a signal transmitted from a microcomputer 14**.

The control power supply circuit 13 generates a DC voltage of 5V which is to be supplied to the microcomputer 14. The motor driving circuit 15 controls a current supply timing to the coil of a stator of the DC fan motor in response to a signal from the microcomputer 14, the signal being transmitted on the basis of rotational position information of the DC fan motor 16. The switch board 17 is fixed to an operation panel of the indoor unit A, and it is provided with an ON/OFF switch, a test driving switch, etc. The reception circuit **18*a* receives various remote control signals (for example, on/off signal, cooling/heating switch signal, room temperature signal, etc.). The display board 18 displays an operation status of the air conditioner. The flap motor 19** operates to move a flap for changing the air flow direction of cooled or heated air.

The indoor control circuit is further provided with a room-temperature sensor 20 for detecting the temperature in a room (room temperature), a heat-exchanger temperature sensor 21 for detecting the temperature of the indoor heat exchanger, and a temperature sensor 22 for detecting the humidity in a room (room humidity). Values measured by these sensors are subjected to A/D conversion, and then supplied to the microcomputer 14. A control signal from the microcomputer 14 is transmitted through a serial circuit 23 and a terminal board $T_3$ to the outdoor unit B.

The indoor control circuit is further provided with a Triac 26 and a heater relay 27. The Triac 26 and the heater relay 27 are controlled through a driver 24 by the microcomputer 14 to stepwise control the power to be supplied to a heater 25 for reheating cooled air which is used in dry operation.

Reference numeral represents an external ROM 30 in which special data indicating the type and the characteristics of the air conditioner are stored. These special data are read out from the external ROM just after a power switch is input and the operation is stopped. When the power switch is input, detection of input of a command from the wireless remote controller 60 and detection of the status of the ON/OFF switch or test driving switch (its operation will be described later) are not performed until the read-out of the special data is completed.

Next, the control circuit for the outdoor unit B will be described with reference to FIG. 3.

The outdoor unit B includes terminal boards $T'_1$, $T'_2$ and $T'_3$ which are connected to terminal boards $T_1$, $T_2$ and $T_3$ of the indoor unit A, a varistor 31 which is connected to the terminal boards $T'_1$ and $T'_2$ in parallel, a noise filter 32, a reactor 34, a voltage doubler for doubling an input voltage, a noise filter 36, and a ripple filter to obtain a DC voltage of about 280 V from an AC voltage of 100V.

In the outdoor unit B, reference numeral 39 represents a serial circuit for converting a control signal supplied from the indoor unit A through the terminal $T'_3$, and the converted signal is transmitted to the microcomputer 41. Reference numeral 40 represents a current detector for detecting current supplied to a load in the outdoor unit B and a current transformer (CT) 33, and rectifying the current into a DC voltage to supply the DC voltage to a microcomputer 41. Reference numeral 42 represents a switch power supply circuit for generating operation power of the microcomputer 41, and reference numeral 38 represents a motor driver which performs PWM control of the power to be supplied to the compressor 1 on the basis of the control signal from the microcomputer 41. The motor driver 38 has six power transistors which are connected to one another in the form of a three-phase bridge to constitute an inverter unit. Reference numeral 43 represents a compressor motor for driving the compressor 1 of the refrigeration cycle, and reference numeral 44 represents a discharge-side temperature sensor for detecting the temperature of the refrigerant at the discharge side of the compressor 1. Reference numeral 45 represents a fan motor whose rotational speed is stepwise controlled in three stages and serves to the outside air to the outdoor heat exchanger. The four-way change-over valve 3 and the electromagnetic valve 10 are controlled to switch a refrigerant passage of the refrigeration cycle as described above. However, the switching operation of these elements may be performed by using various manners.

The outdoor unit B is further provided with a outdoor temperature sensor 48 for detecting the temperature of the outside which is disposed in the vicinity of an air intake port, and an outdoor heat-exchanger temperature sensor 49 for detecting the temperature of the outdoor heat exchanger. Detection values obtained by these temperature sensors 48 and 49 are subjected to A/D conversion, and then transmitted to the microcomputer 41.

Reference numeral 50 represents an external ROM having the same function as the external ROM 30 of the indoor unit A. Data which are inherent to the outdoor unit B and similar to those stored in the external ROM 30 are stored in the external ROM 50. Reference character F in each of the indoor and outdoor units A and B represents a fuse.

Each of the microcomputers (control members) 14 and 41 includes a ROM which stores programs in advance, a RAM which stores reference data, and a CPU for operating the programs in the same housing (for example, 87C196MC (MCS-96 series) of Intel Corporation Sales).

Next, the refrigerant used in the air conditioner will be described in detail.

Both single refrigerant and mixture refrigerant may be used in the present invention. The following description is representatively made when the mixture refrigerant is used in the present invention. In this specification, "mixture refrigerant" means refrigerant which is obtained by mixing two or more kinds of refrigerant which have different characteristics.

For example, R-410A or R-410B is used as the mixture refrigerant. R-410A is mixture refrigerant of two-components system, and it is formed of 50 Wt % R-32 and 50 Wt % R-125. R-140A has a boiling point of −52.2° C., and a dew point of −52.2° C. R-410B is formed of 45 Wt % R-32 and 55 Wt % R-125.

When, the mixture refrigerant as described above is used in the refrigerant circuit, the discharge temperature of the compressor is equal to 73.6° C. for R-410A (66.0° C. for HCFC−22), the condensation pressure is equal to 27.30 bar for R-410A (17.35 bar for HCFC−22), and the evaporation pressure is equal to 10.86 bar for R-410A (6.79 bar for HCFC−22). Accordingly, as compared with the conventional single refrigerant of HCFC−22, the mixture refrigerant (R-410A) used in the present invention provides high temperature and high pressure to the whole refrigerant circuit.

Further, when azeotropic mixture refrigerant formed of R-410A and R-410B or the like is used, there is little variation in refrigerant composition because the boiling points of the respective components are substantially equal to each other, so that such a problem as "temperature glide" is not required to be taken in consideration. Therefore, the control under air-conditioning operation can be easily performed.

The values shown in parentheses in the refrigerant circuit of FIG. 2 represent the actual dimension of refrigerant pipes. That is, in the refrigerant circuit of FIG. 2, the dimension of a refrigerant pipe between the four-way change-over valve 3 and the indoor heat exchanger 7 is set to ⅜" (inch), the dimension of a refrigerant pipe between the indoor heat exchanger 7 and the screen filter (strainer) 6 is set to ¼" (inch), the dimension of a refrigerant pipe between the capillary tube 5 and the outdoor heat exchanger 4 is set to ¼" (inch), the dimension of a bypass pipe of the outdoor heat exchanger 4 is set to ⅛" (inch), the dimension of a refrigerant pipe between the four-way change-over valve 2 and the accumulator 7 is set to ⅜" or ½" (inch), and the dimension of a refrigerant pipe between the four-way change-over valve and the outdoor heat exchanger 4 is set to ⅜" (inch). The dimension of each of the refrigerant pipes in the refrigerant circuit is not limited to a specific value, however, the air conditioner (heat exchanger) having the highest efficiency can be provided by setting the dimension of each of the refrigerant pipes of the refrigerant circuit to the above values in consideration of the relationship with a refrigerant pipe which is inserted into the heat exchanger.

The heat exchanger of the present invention is used as any one of the heat exchanger at the user side (indoor heat exchanger) 7 and the heat exchanger at the heat source side (outdoor heat exchanger) 4, however, the following description is made particularly in the case where the heat exchanger of the present invention is used as the indoor heat exchanger 7 which needs a higher heat exchange efficiency from the viewpoint of an air flow amount.

Figure 4:
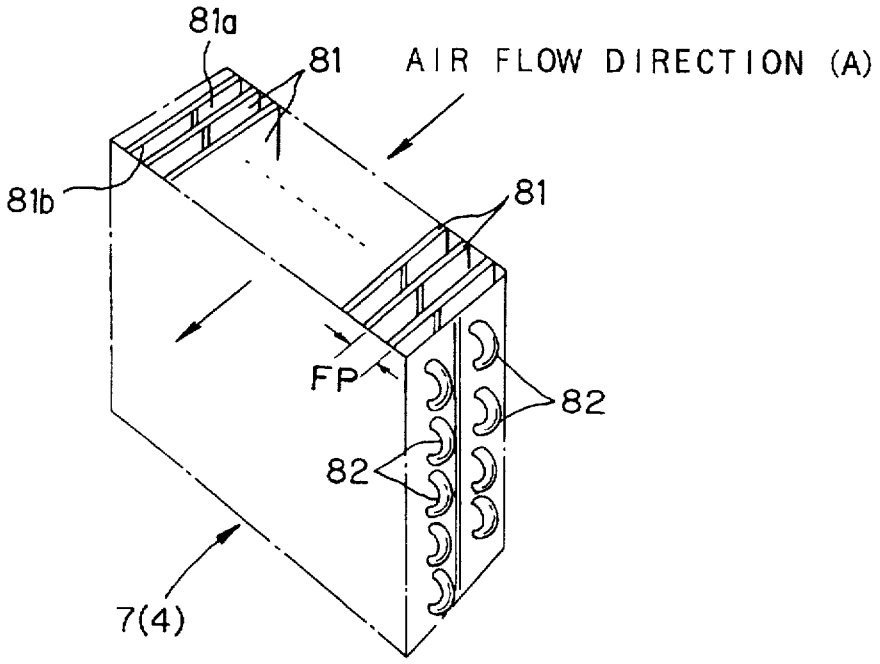
FIG. 4 is a perspective view showing a first embodiment of a heat exchanger used in the refrigerant circuit shown in FIG. 2.

FIG. 4 shows a first embodiment of the heat exchanger according to the present invention.

As shown in FIG. 4, the heat exchanger 7 comprises many fin members 81 which are arranged in a multilayer structure (hereinafter referred to as "multilayered fin members"), and a refrigerant pipe 82 which is inserted in the multilayered fin members 81 so as to be arranged in a meandering form.

Figure 5:
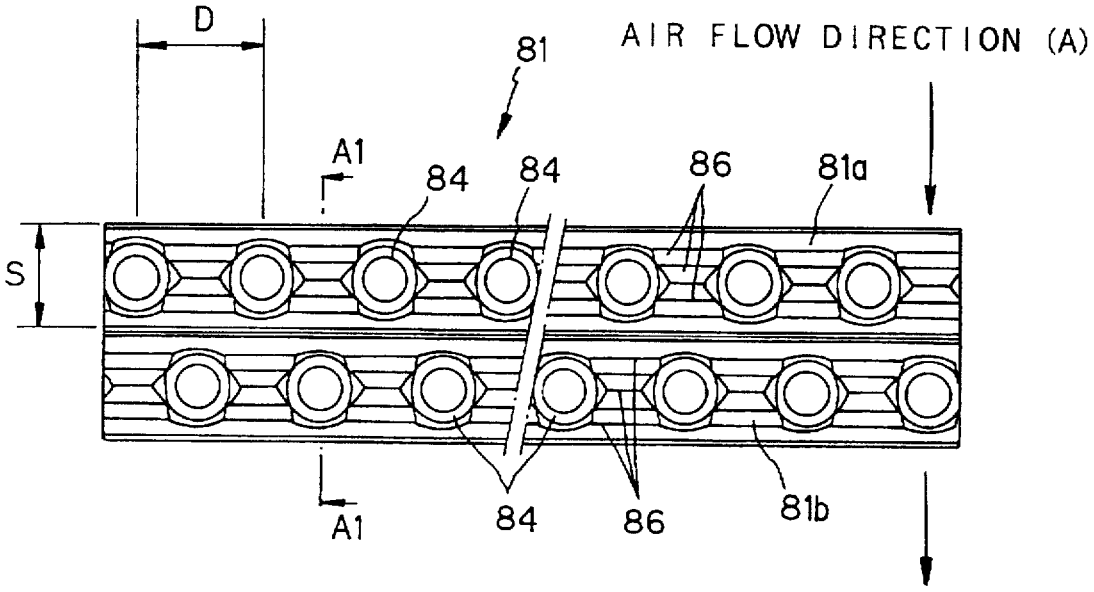
FIG. 5 is a plan view showing a fin used in the heat exchanger of the refrigerant circuit.
Figure 7:
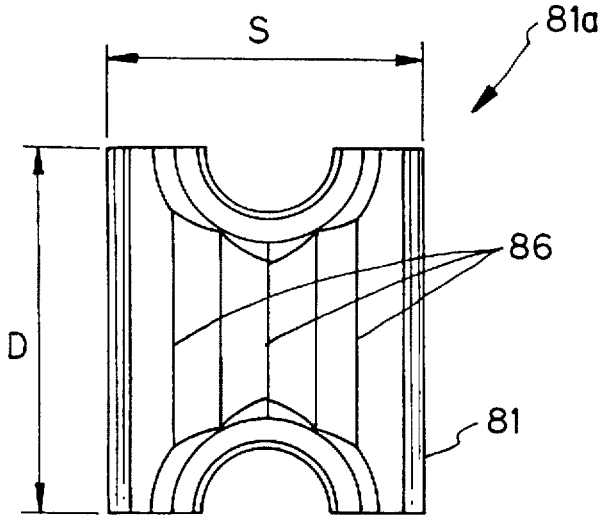
FIG. 7 is a plan view showing a part of the fin body of FIG. 4.

In this embodiment, a pipe having a diameter of 7 mm is used as the refrigerant pipe, however, the diameter of the pipe is not limited to this value. For example, a pipe having a diameter of 9 mm or the like may be used. As shown in FIGS. 5 and 7, the pitch D of the meandered refrigerant pipe 82 is not limited to a specific value, however, in this embodiment, the pitch D is set to about 21 mm because the highest heat exchange efficiency could be experimentally obtained at this value.

Figure 6:
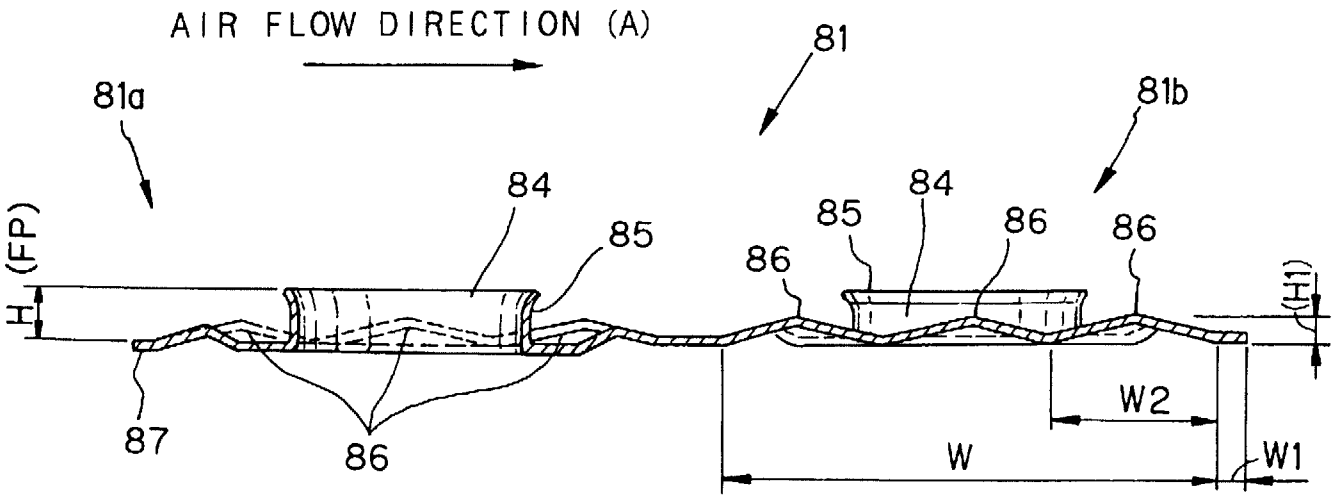
FIG. 6 is an enlarged cross-sectional view showing the body of the fin of FIGS. 4 and 5, which is taken along a line A1–A1 of FIG. 5.

In this embodiment, each fin member 81 is formed by integrally fabricating two fins 81*a* and 81*b* into one fin having a planar body as shown in FIGS. 4 and 5. In other words, each fin member 81 is formed by arranging two fins 81*a* and 81*b* in parallel as shown in FIGS. 5 and 6. However, the fin member 81 may be formed by a single planar fin. These plural fin members 81 are multilayered at a predetermined interval so as to be arranged in parallel to an air flow direction as indicated by an arrow A.

The fin member 81 is formed of material having excellent thermal conduction characteristics, such as aluminum.

Figure 8:
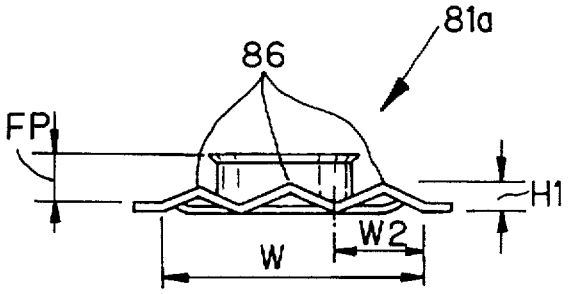
FIG. 8 is a cross-sectional view of the fin shown in FIG. 4.

The multilayered fin members 81 are arranged away from each other at an interval (fin pitch) FP, and the fin pitch FP is preferably set to 1.2 to 1.7 mm because this pitch range could experimentally provide the most highest heat exchange efficiency. Further, two train of pipe penetrating holes 84 through which the meandered refrigerant pipe 82 penetrates are formed in the fins 81*a* and 81*b* of each fin member 81 in its longitudinal direction so that the arrangement of the refrigerant pipe 82 on the fins 81*a* and 81*b* is wobbled in the longitudinal direction of the fin member 81 as shown in FIG. 5. Each pipe penetration hole 84 is defined and sectioned by each projecting portion 85, and the height H of the projecting portion defines the fin pitch FP as shown in FIGS. 6 and 8.

The main feature of the present invention resides in that the surface of each of the fins of the fin members is designed to be corrugated in the air flow direction (as indicated by the arrow A) as described later, whereby the heat exchange efficiency can be enhanced.

FIG. 6 is a cross-sectional view of the fin member 81 used in the heat exchanger of the first embodiment of the fin member 81. In this embodiment, three wavelike portions (corrugated portion) 86 are continuously formed in the air flow direction (in the thickness direction of the fin) on the fin 81*a* (81*b*) as shown in FIG. 6, and each wavelike portion has a triangular section.

Here, the dimension of each part of the fin member 81 of this embodiment will be described.

The width of each fin 81*a*, 81*b* is determined on the basis of the balance between requirements for enhancement of the heat exchange efficiency and miniaturization of the fin design. In this embodiment, the width of the fin 81*a*, 81*b* is preferably set to 18 to 19 mm because this range could experimentally provide the highest heat exchange efficiency. In this specification, "width" means a dimension in the air flow direction to the fin (i.e., in the direction as indicated by the arrow A).

Figure 9:
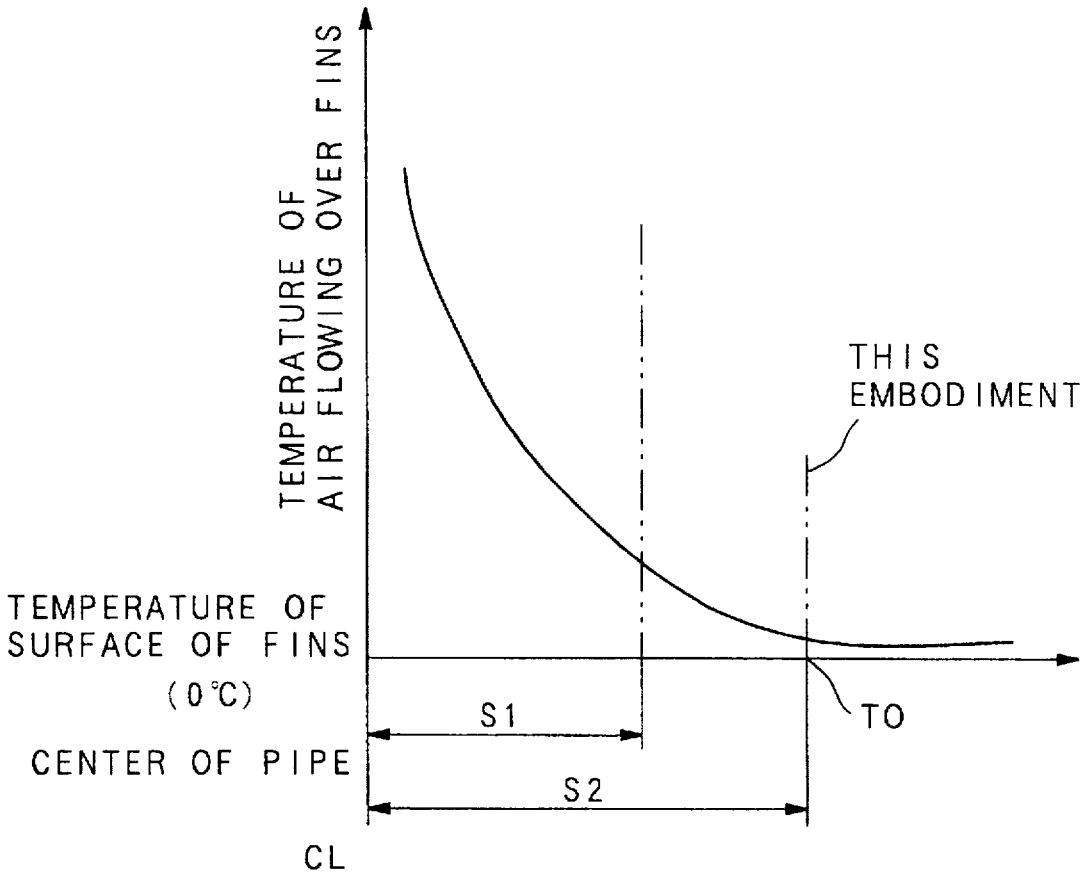
FIG. 9 is a graph showing the relationship between the width of the fin and the temperature of air passing over the fin.

FIG. 9 is a graph showing the relationship between the temperature of air passing over the fin (on the ordinate axis of FIG. 9) and the distance from the center of the refrigerant pipe to the edge portion of the fin in the thickness direction thereof (the half of the fin width) (on the abscissa axis of FIG. 9). As is apparent from FIG. 9, the heat exchange efficiency is reduced as the temperature difference between the surface of the fin and the passing air is small. In FIG. 9, no further reduction in the temperature of the passing air is expected in an area which is farther away from a position T0 because there is little temperature difference between the fin temperature and the air temperature in this area. Therefore, the distance from the center of the refrigerant pipe to the position corresponding to the temperature T0 is preferably set to a half (S2) of the width of the fin 81*a*, 81*b*. If the fin width is smaller than the double of the distance S2 (for example, the fin width is set to the double of a distance S1), the air temperature cannot be sufficiently reduced. On the other hand, if the fin width is larger than the double of the distance S2, the air passing over the fin has been sufficiently reduced in temperature, and thus no further enhancement of the heat exchange efficiency (reduction of the air temperature) is expected even if the fin width is set to be larger.

In this embodiment, the position T0 ) is determined so that the air temperature is reduced by 6° C., and the distance S2 at this time is adopted. Further, the double of the distance S2 is adopted as an effective width S (=18.19 mm) of the fin 81*a* (fin 81*b*).

Next, the detailed structure of the wavelike portions (corrugated portion) 86 formed on each fin 81*a* (81*b*) of this embodiment will be described in detail.

As shown in FIG. 6, each fin 81*a*, 81*b* having an effective width S comprises a corrugated portion having a width W, and flat edge portions 87 each having a width of W1 which are formed at both edges of the fin to guide the flow of air in the thickness direction of the fin. The corrugated portion having the width W is trisectioned into three wavelike portions (projections) 86 each having a width W2.

In this embodiment, since the effective width S of each fin is set to 18.19 mm and the width W1 of each edge portion 87 is set to 0.8 mm, the width W of the corrugated portion is set to 16.59 mm (=18.19−0.8×2), and the width W2 of each wavelike portion 86 is set to 5.53 mm (=16.59/3).

The height H1 of each wavelike portion 86 formed on the fin is determined so that each wavelike portion 86 serves as a resistor against the flow of air to produce such a turbulent flow enough to break a temperature boundary layer occurring on the fin. If the wavelike portions 86 are excessively high, a pressure loss is excessively large, and thus the heat exchange efficiency is rather lowered. The height H1 of the wavelike portions 86 is determined in consideration of the two conflicting conditions as described above, that is, the height H1 is required to be set so that a turbulent flow enough to break the temperature boundary layer can be produced and at the same time the resistance to the air flow can be minimized. In order to satisfy this requirement, according to this embodiment, the ratio of the height H1 of each wavelike portion 86 to the width W2 thereof (H1/W2) is set to 1/7 to 1/8 (i.e., H1 is set to one-seventh to one-eighth of W2). Specifically, the height H1 of the wavelike portion 86 is preferably set to 0.5 to 1.0 mm because it could experimentally provide the highest heat exchange efficiency, and more preferably it is set to 0.7 mm.

Since the width W2 of each wavelike portion 86 is set to 5.53 mm as described above, the dimensional ratio (H1/W2) of the height H1 to the width W2 is set to about 1/8.

The crest and trough of each wavelike portion 86 may be rounded to facilitate the manufacturing process of the fins.

Next, the operation of the air conditioner using the heat exchanger according to this embodiment will be described.

In cooling operation, the four-way change-over valve 3 is switched as indicated by the solid line, and the refrigerant discharged from the compressor 1 is circulated through the muffler 2, the four-way change-over valve 3, the heat-source side heat exchanger (outdoor heat exchanger) 4, the capillary tube 5, the screen filter 6, the user-side heat exchanger (indoor heat exchanger) 7, the muffler 8, the four-way change-over valve 3 and the accumulator 9 in this order in the refrigerant circuit. In this case, the user-side heat exchanger 7 serves as an evaporator, and the refrigerant is reduced in pressure by the capillary tube 5.

On the other hand, in heating operation, the four-way change-over valve 3 is switched as indicated by the dotted line, and the refrigerant discharged from the compressor is circulated through the muffler 2, the four-way change-over valve 3, the muffler 8, the user-side heat exchanger (indoor heat exchanger) 7, the screen filter 6, the capillary tube 5, the heat-source side heat exchanger (outdoor heat exchanger) 4, the four-way change-over valve 3 and the accumulator 9 in this order in the refrigerant circuit. In this case, the heat-source side heat exchanger 4 serves as an evaporator, and the refrigerant is reduced in pressure by the capillary tube.

In cooling or heating operation, the air is heat-exchanged with the refrigerant passing in the refrigerant pipe by the indoor heat exchanger 7 while blown through the indoor heat exchanger 7 by a fan. In this embodiment, the air is heat-exchanged while passing through the gaps between the multilayered fin members 81.

The air passing through the gaps between the fin members 81 forms a turbulent flow having such strength that the temperature boundary layer of air can be broken, but the pressure loss is not so large, so that a high heat exchange efficiency can be obtained to enhance the air conditioning power of the air conditioner.

According to this embodiment, since the three wavelike portions are formed along the air flow direction on the fin of the heat exchanger, a turbulent flow enough to break the temperature boundary layer can be formed, resulting in enhancement of the heat exchange efficiency. In addition, the turbulent flow thus formed does not excessively increase its resistance to the air flow, and thus the pressure loss is not increased. Therefore, the heat exchange efficiency of the whole heat exchanger can be enhanced.

Furthermore, according to this embodiment, the width of the fin is set to two to three times of the pipe diameter of the refrigerant pipe, the width of each wavelike portion is set by substantially trisectioning the fin width, and the height of the wavelike portion is set to one-seventh to one-eighth of the width of the wavelike portion, whereby the heat exchange efficiency based on the temperature difference between the air and the fin in the heat exchange operation can be maximized, and at the same time the fin width can be minimized.

Still furthermore, according to this embodiment, the heat exchanger as described above is used in an air conditioner. Therefore, an air conditioner having a high heat exchange efficiency can be provided, and the air-conditioning power can be enhanced. Further, high-temperature HFC-based refrigerant can be used as refrigerant particularly in the air conditioner as described above.

Next, a second embodiment of the heat exchanger according to the present invention will be described with reference to FIGS. 10 to 15.

Figure 10:
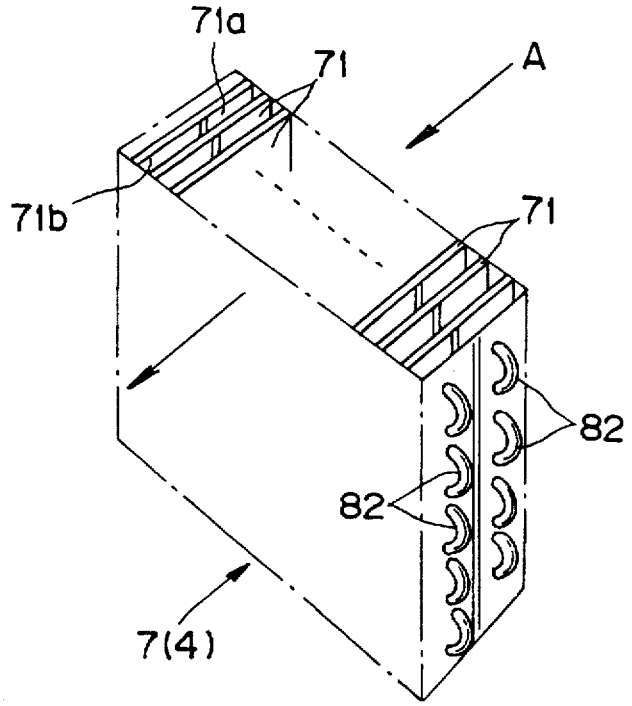
FIG. 10 is a perspective view showing a second embodiment of the heat exchanger of the refrigerant circuit.

FIG. 10 is a perspective view showing the second embodiment of the heat exchanger of the present invention. As shown in FIG. 10, the heat exchanger of this embodiment comprises many fin members 71 which are arranged in a multilayer structure on each other, and the refrigerant pipe 82 is inserted in the multilayered fin members 71 so as to be arranged in the meandering form, like the fin members 81 of the first embodiment.

Figure 11:
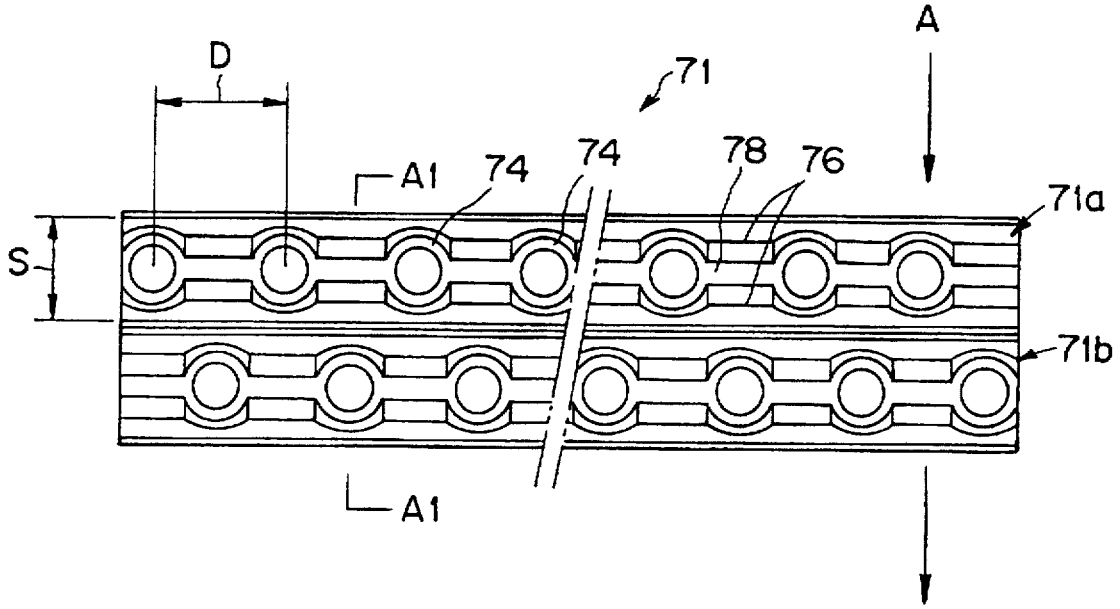
FIG. 11 is a plan view showing a fin used in the heat exchanger of the second embodiment.
Figure 13:
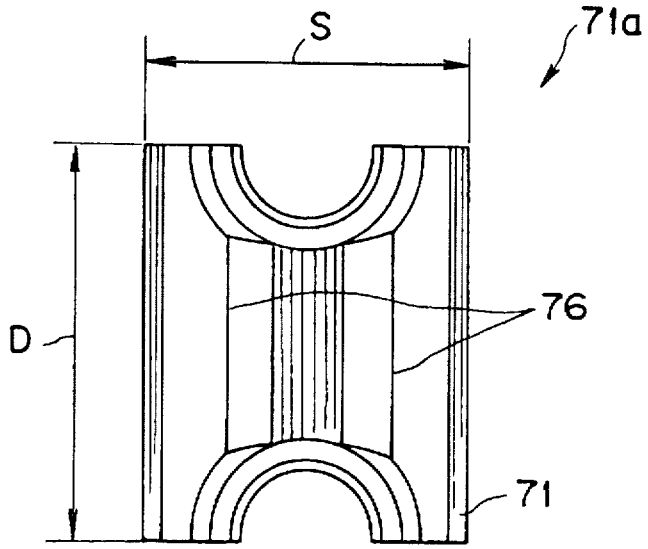
FIG. 13 is a plan view showing a part of the fin of FIG. 11.
Figure 14:
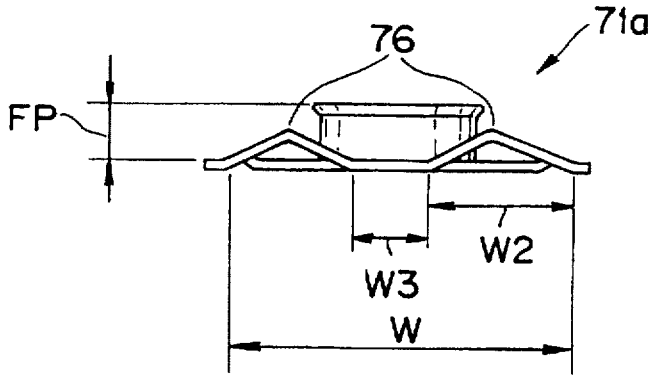
FIG. 14 is a cross-sectional view of the fin shown in FIG. 13.

Like the first embodiment, a pipe having a diameter of 7 mm is used as the refrigerant pipe in this embodiment. However, the diameter of the pipe is not limited to this value. For example, a pipe having a diameter of 9 mm or the like may be used. As shown in FIGS. 11 and 13, the pitch D of the meandered refrigerant pipe 82 is not limited to a specific value, however, in this embodiment, the pitch D is set to about 21 mm because the highest heat exchange efficiency could be experimentally obtained at this value.

Further, in this embodiment, each fin member 71 is formed by integrally fabricating two fins **71*a* and 71*b* into one fin having a planar body as shown in FIGS. 10 and 11. In other words, each fin member 71 is formed by arranging two fins 71*a* and 71*b* in parallel as shown in FIGS. 10 and 11. However, the fin member 71 may be formed by a single planar fin. These plural fin members 71** are multilayered at a predetermined interval so as to be arranged in parallel to an air flow direction as indicated by an arrow A.

The fin member 71 is formed of material having excellent thermal conduction characteristics, such as aluminum.

The multilayered fin members 71 are arranged away from each other at an interval (fin pitch) FP, and the fin pitch FP is preferably set to 1.2 to 1.6 mm because this pitch range could experimentally provide the most highest heat exchange efficiency. Further, two train of pipe penetrating holes 74 through which the meandered refrigerant pipe 82 penetrates are formed in the fins **71*a* and 71*b* of each fin member 71 in its longitudinal direction so that the arrangement of the refrigerant pipe 82 on the fins 71*a* and 71*b* is wobbled in the longitudinal direction of the fin member 71 as shown in FIG. 11. Each pipe penetration hole 74 is defined and sectioned by each projecting portion 75 as shown in FIG. 12, and the height H of the projecting portion 75 defines the fin pitch FP as shown in FIG. 12**.

Figure 12:
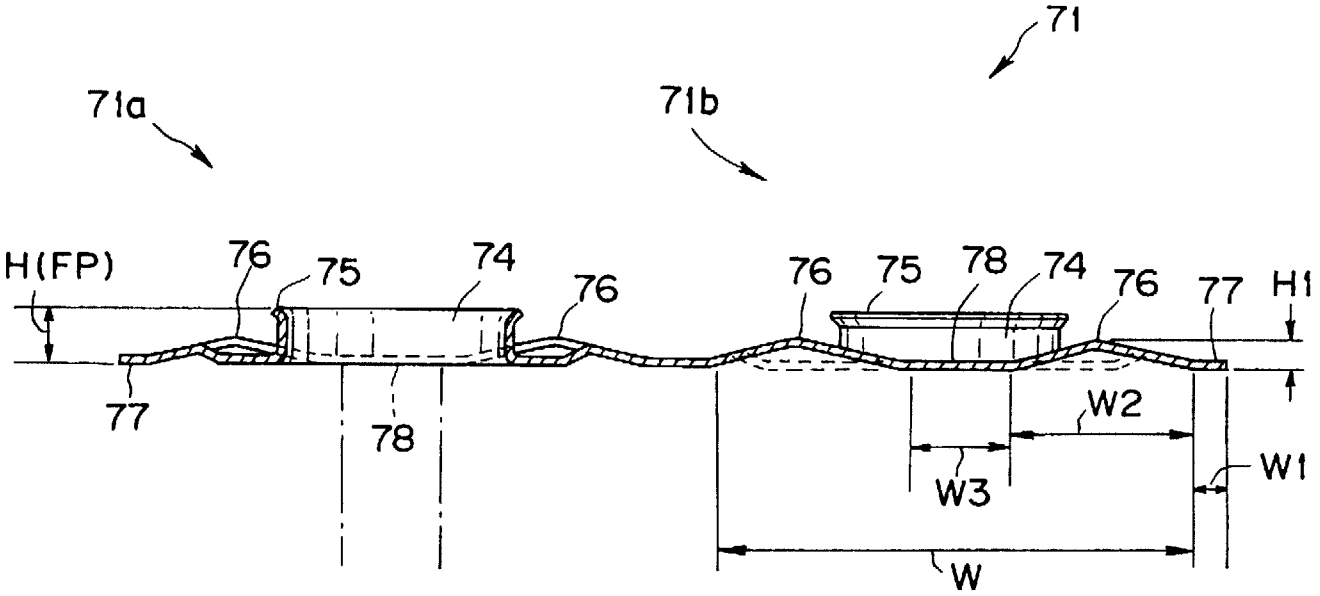
FIG. 12 is an enlarged cross-sectional view of the fin of FIG. 11, which is taken along a A—A line of FIG. 11.

FIG. 12 is a cross-sectional view of the fin member 71 used in the heat exchanger of the second embodiment. In this embodiment, on each fin **71*a* (71*b*) are formed the wavelike portions (corrugated portion) 76 in the air flow direction (in the thickness direction of the fin), and a flat portion 78 interposed between the wavelike portions 76 as shown in FIG. 12**, whereby the heat exchange efficiency is enhanced more.

Here, the dimension of each part of the fin member 71 of this embodiment will be described.

The width of each fin **71*a*, 71*b* is determined on the basis of the balance between requirements for enhancement of the heat exchange efficiency and miniaturization of the fin design. In this embodiment, the width of the fin 71*a*, 71*b*** is preferably set to 18 to 19 mm because this range could experimentally provide the highest heat exchange efficiency.

As is apparent from FIG. 9, like the first embodiment, the heat exchange efficiency is also reduced as the temperature difference between the surface of the fin and the passing air is small. As described in the first embodiment, no further reduction in the temperature of the passing air is expected in an area which is farther away from a position T0 because there is little temperature difference between the fin temperature and the air temperature in this area. Therefore, in this embodiment, the distance from the center of the refrigerant pipe to the position corresponding to the temperature T0 is also preferably set to a half (S2) of the width of the fin 71*a*, 71*b*. If the fin width is smaller than the double of the distance S2 (for example, the fin width is set to the double of a distance S1), the air temperature cannot be sufficiently reduced. On the other hand, if the fin width is larger than the double of the distance S2, the air passing over the fin has been sufficiently reduced in temperature, and thus no further enhancement of the heat exchange efficiency (reduction of the air temperature) is expected even if the fin width is set to be larger.

In this embodiment, the position T0 is determined so that the air temperature is reduced by 6° C., and the distance S2 at this time is adopted. Further, the length which is double the distance S2 is adopted as an effective width S (=18.19 mm) of the fin 71*a* (fin 71*b*).

Next, the detailed structure of the wavelike portions (corrugated portion) 76 formed on each fin 71*a* (71*b*) of this embodiment will be described.

As shown in FIG. 12, each fin 71*a*, 71*b* having an effective width S comprises a corrugated portion having a width W, and flat edge portions 77 each having a width of W1 which are formed at both edges of the fin to guide the flow of air in the thickness direction of the fin. The corrugated portion having the width W includes two wavelike portions (projections) 76 each having a width W2, and a flat portion 78 disposed between the wavelike portions 76.

The width W1 of the edge portion 77 is set to 0.8 mm, for example, and the width of the corrugated portion is set to 18.19−0.8×2=16.59 mm.

As described above, two wavelike portions 76 and a flat portion 78 disposed between the wavelike portions 76 are formed on the corrugated portion. The width W3 of the flat portion 78 is set to a half value of the width W2 of each wavelike portion, that is, W3=W2/2 because the above dimensional setting of each part was experimentally proved to provide the highest heat exchange efficiency.

Specifically, the width W2 of the wavelike portion is set to 6.636 mm, and the width W3 of the flat portion 78 is set to 3.318 mm.

Like the first embodiment, the height H1 of each wavelike portion 76 formed on the fin is determined so that each wavelike portion 76 serves as a resistor against the flow of air to produce such a turbulent flow enough to break a temperature boundary layer occurring on the fin. If the wavelike portions 76 are excessively high, a pressure loss is excessively large, and thus the heat exchange efficiency is rather lowered.

The height H1 of the wavelike portion 76 is determined in consideration of the two conflicting conditions as described above, that is, the height H1 is required to be set so that a turbulent flow enough to break the temperature boundary layer can be produced and at the same time the resistance to the air flow can be minimized. In order to satisfy this requirement, according to this embodiment, the ratio of the height H1 of each wavelike portion 96 to the width W2 thereof (H1/W2) is set to ⅛ to 1/9 (i.e., H1 is set to one-eighth to one-ninth of W2). Specifically, the height H1 of the wavelike portion 76 is preferably set to 0.5 to 1.0 mm because it could experimentally provide the highest heat exchange efficiency, and more preferably it is set to 0.8 mm (i.e., H1/W2 is set to about ⅛).

The crest and trough of each wavelike portion 76 may be rounded to facilitate the manufacturing process of the fins.

The operation of the air conditioner using the heat exchanger according to this embodiment is identical to that of the first embodiment, and the detailed description thereof is omitted.

In cooling or heating operation, the air is heat-exchanged with the refrigerant passing in the refrigerant pipe by the indoor heat exchanger 7 while blown through the indoor heat exchanger 7 by a fan. In this embodiment, the air is heat-exchanged while passing through the gaps between the multilayered fin members 71.

The air passing through the gaps between the fin members 71 forms a turbulent flow having such strength that the temperature boundary layer of air can be broken, but the pressure loss is not so large, so that a high heat exchange efficiency can be obtained to enhance the air conditioning power of the air conditioner.

Particularly when HFC-based refrigerant is used as refrigerant, the refrigerant circuit is kept in a high-pressure and high-temperature state. However, even in such a severe condition, each of the indoor air and the outside air can be sufficiently heat-exchanged by the heat exchanger.

Further, the flat portion 78 is provided between the wavelike portions 96, so that the fin members 76 drain well and thus it is hardly frosted.

According to this embodiment, since the two wavelike portions and the flat portion are formed along the air flow direction on the fin of the heat exchanger, a turbulent flow enough to break the temperature boundary layer can be formed, resulting in enhancement of the heat exchange efficiency. In addition, the turbulent flow thus formed does not excessively increase its resistance to the air flow, and thus the pressure loss is not increased. Therefore, the heat exchange efficiency of the whole heat exchanger can be enhanced.

According to this embodiment, the width of the fin is set to two to three times of the pipe diameter of the refrigerant pipe, the width of the flat portion is set to a half of the width of the wavelike portion, and the height of the wavelike portion is set to one-eighth to one-ninth of the width of the wavelike portion, whereby the heat exchange efficiency based on the temperature difference between the air and the fin in the heat exchange operation can be maximized, and at the same time the fin width can be minimized.

Furthermore, according to this embodiment, the heat exchanger as described above is used in an air conditioner. Therefore, an air conditioner having a high heat exchange efficiency can be provided, and the air-conditioning power can be enhanced. In addition, high-temperature HFC-based refrigerant can be used as refrigerant particularly in the air conditioner as described above.

Next, a third embodiment of the heat exchanger according to the present invention will be described with reference to FIGS. 15 to 19.

Figure 15:
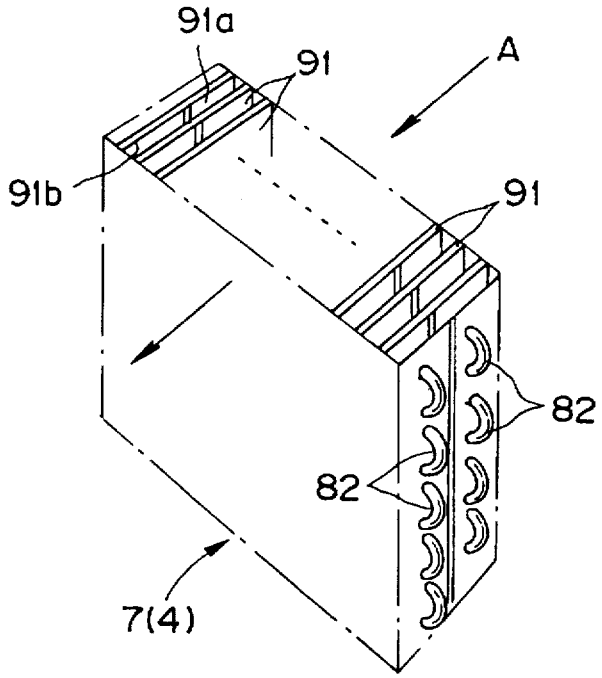
FIG. 15 is a perspective view showing a third embodiment of the heat exchanger of the refrigerant circuit.

FIG. 15 is a perspective view showing the third embodiment of the heat exchanger of the present invention. As shown in FIG. 15, the heat exchanger of this embodiment comprises many fin members 91 which are multilayered on each other (i.e., arranged in a multilayer structure), and the refrigerant pipe 82 is inserted in the multilayered fin members 91 so as to be arranged in the meandering form, like the fin members 81 and 71 of the first and second embodiments.

Figure 16:
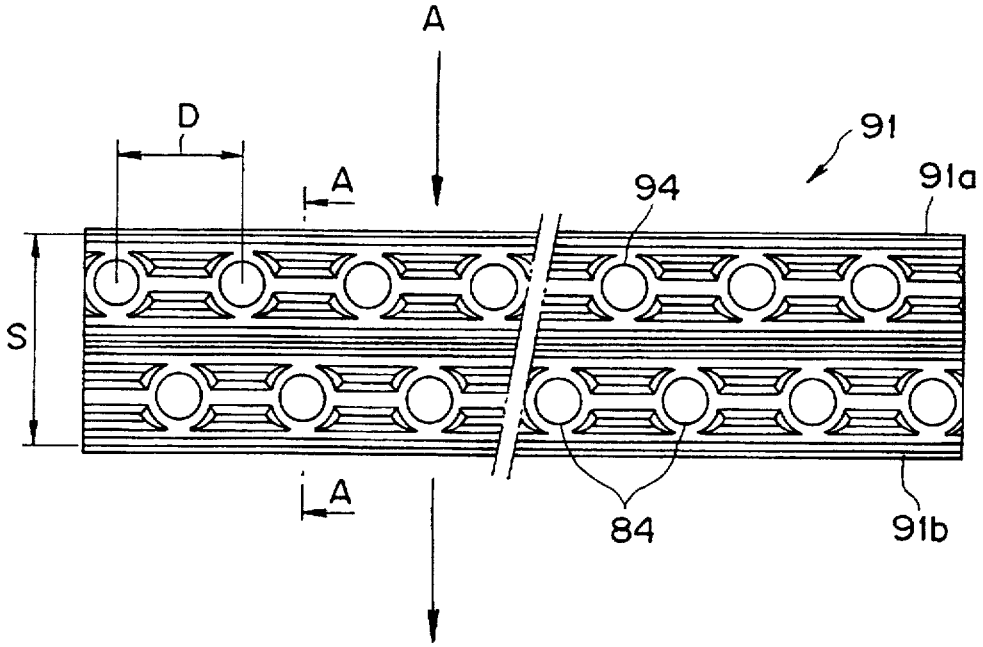
FIG. 16 is a plan view of a fin used in the third embodiment of the heat exchanger shown in FIG. 15.
Figure 18:
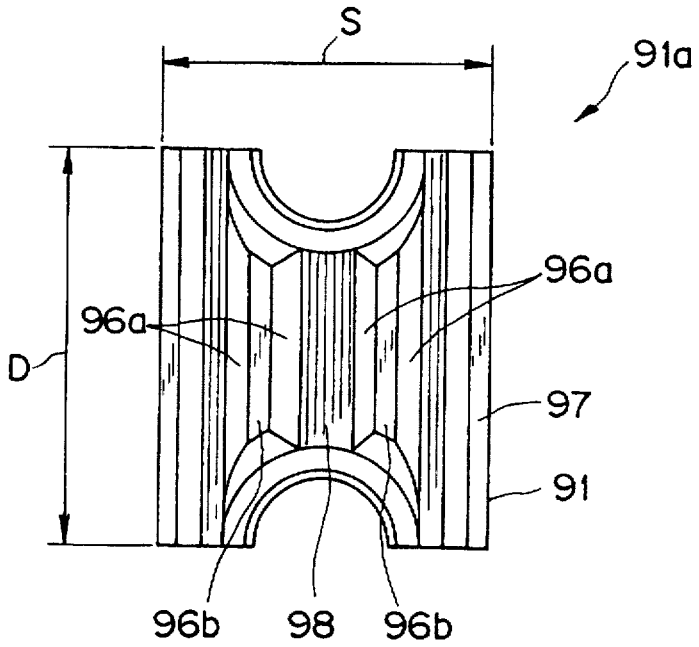
FIG. 18 is a plan view of a part of the fin shown in FIG. 16.

Like the first and second embodiments, a pipe having a diameter of 7 mm is used as the refrigerant pipe in this embodiment. However, the diameter of the pipe is not limited to this value. For example, a pipe having a diameter of 9 mm or the like may be used. As shown in FIGS. 16 and 18, the pitch D of the meandered refrigerant pipe 82 is not limited to a specific value, however, in this embodiment, the pitch D is set to about 21 mm because the highest heat exchange efficiency could be experimentally obtained at this value.

Figure 17:
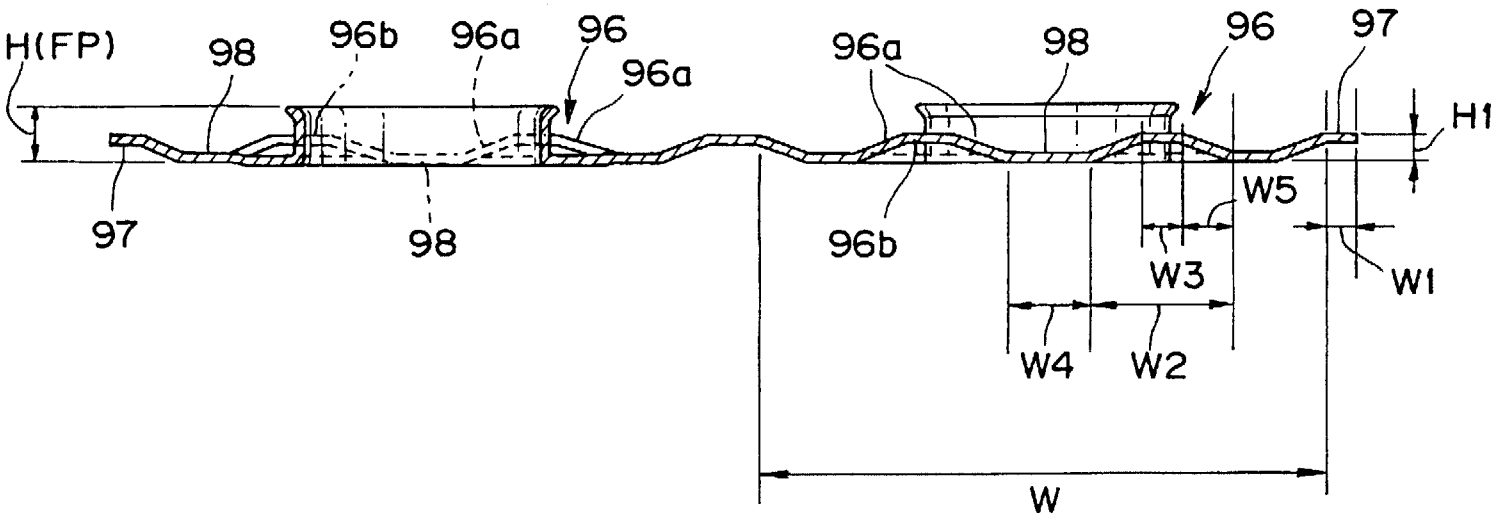
FIG. 17 is an enlarged cross-sectional view of the fin shown in FIG. 16, which is taken along a line A1—A1 of FIG. 16.

Further, in this embodiment, each fin member 91 is formed by integrally fabricating two fins 91*a* and 91*b* into one fin having a planar body as shown in FIGS. 16 and 17. In other words, each fin member 91 is formed by arranging two fins 91*a* and 91*b* in parallel as shown in FIGS. 16 and 17. However, the fin member 91 may be formed by a single planar fin. These plural fin members 91 are multilayered at a predetermined interval so as to be arranged in parallel to an air flow direction as indicated by an arrow A.

The fin member 91 is formed of material having excellent thermal conduction characteristics, such as aluminum.

Figure 19:
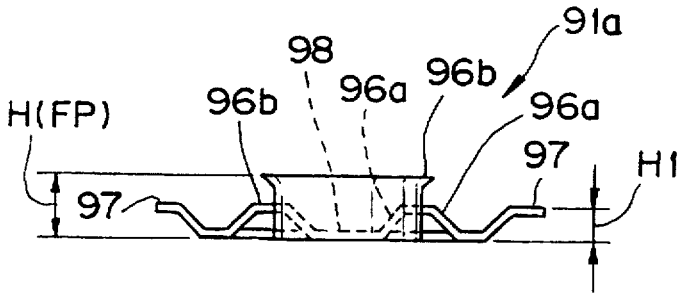
FIG. 19 is a cross-sectional view of the fin shown in FIG. 18.

The multilayered fin members 91 are arranged away from each other at an interval (fin pitch) FP, and the fin pitch FP is preferably set to 1.2 to 1.8 mm because this pitch range could experimentally provide the most highest heat exchange efficiency. Further, two train of pipe penetrating holes 94 through which the meandered refrigerant pipe 82 penetrates are formed in the fins 91*a* and 91*b* of each fin member 81 in its longitudinal direction so that the arrangement of the refrigerant pipe 82 on the fins 91*a* and 91*b* is wobbled in the longitudinal direction of the fin member 91 as shown in FIG. 16. Each pipe penetration hole 94 is defined and sectioned by each projecting portion 55, and the height H of the projecting portion 95 defines the fin pitch FP as shown in FIGS. 17 and 19.

FIG. 17 is a cross-sectional view of the fin member 91 used in the heat exchanger of the third embodiment. In this embodiment, on each fin 91*a* (91*b*) is formed tho wavelike portions (corrugated portion) 96 in the air flow direction (in the thickness direction of the fin), and a flat portion 98 interposed between the wavelike portions as shown in FIG. 17. The crest portion of each wavelike portion is flattened, and thus the wavelike portion has a trapezoidal section, whereby the heat exchange efficiency is enhanced more. In this sense, the wavelike portion 96 of the third embodiment is hereinafter referred to as "trapezoidal wavelike portion"). Each trapezoidal wavelike portion 96 comprises two (right and left) ramp portions (slant rise-up portions) 96*a* and an upper flat portion 96*b* between the ramp portions 96*a*.

Accordingly, the main difference between the second and third embodiments resides in that the crest portion of each wavelike portion is flattened in the third embodiment.

Here, the dimension of each part of the fin member 91 of this embodiment will be described.

The width of each fin 91*a*, 91*b* is determined on the basis of the balance between requirements for enhancement of the heat exchange efficiency and miniaturization of the fin design. In this embodiment, the width of the fin 91*a*, 91*b* is preferably set to 18 to 19 mm because this range could experimentally provide the highest heat exchange efficiency.

As is apparent from FIG. 9, like the first and second embodiments, the heat exchange efficiency is also reduced as the temperature difference between the surface of the fin and the passing air is small. As described in the first and second embodiments, no further reduction in the temperature of the passing air is expected in an area which is farther away from a position T0 because there is little temperature difference between the fin temperature and the air temperature in this area. Therefore, in the third embodiment, the distance from the center of the refrigerant pipe to the position corresponding to the temperature T0 is also preferably set to a half (S2) of the width of the fin 91*a*, 91*b*. If the fin width is smaller than the double of the distance S2 (for example, the fin width is set to the double of a distance S1), the air temperature cannot be sufficiently reduced. On the other hand, if the fin width is larger than the double of the distance S2, the air passing over the fin has been sufficiently reduced in temperature, and thus no further enhancement of the heat exchange efficiency (reduction of the air temperature) is expected even if the fin width is set to be larger.

In this embodiment, the position T0 is determined so that the air temperature is reduced by 6° C., and the distance S2 at this time is adopted. Further, the length which is double the distance S2 is adopted as an effective width S. (=18.19 mm) of the fin 91*a* (fin 91*b*).

Next, the detailed structure of the trapezoidal wavelike portions (corrugated portion) 96 formed on each fin 91*a* (91*b*) of this embodiment will be described.

As shown in FIG. 17, each fin 91*a*, 91*b* having an effective width S comprises a corrugated portion having a width W, and flat edge portions 97 each having a width of W1 which are formed at both edges of the fin to guide the flow of air in the thickness direction of the fin. The corrugated portion having the width W includes a left ramp portion 96*a*, two trapezoidal wavelike portions (projections) 96 each having a width W2, a flat portion 98 disposed between the trapezoidal wavelike portions and a right ramp portion 96*a*.

The width W1 of the edge portion 97 is set to 0.8 mm. The edge portion 97 is formed to have the same shape as a half portion of the upper flat portion 96*b* of the trapezoidal wavelike portion 96, and it is disposed at a height H1 from the flat portion 98.

The width W5 of the ramp portion 96*a* and the width W3 of the upper flat portion 96*b* are equal to each other, and the width W4 of the flat portion 98 is set to be double as large as W5 or W3 (i.e., W4=2W5 or 2W3). The width W2 of the trapezoidal wavelike portion 96 is equal to (W3+2×W5)= 3×W3 (or 3×W5). The above dimensional setting of each part was experimentally proved to provide the highest heat exchange efficiency.

Specifically, the width W2 of the trapezoidal wavelike portion is set to 4.1445 mm, the width W3 of the upper flat portion 96*b* is set to 1.3815 mm, the width W4 of the flat portion 98 is set to 2.7636 mm, and the width W5 of the ramp portion 96*a* is set to 1.3815 mm.

Like the first and second embodiments, the height H1 of each trapezoidal wavelike portion 96 formed on the fin is determined so that each wavelike portion 96 serves as a resistor against the flow of air to produce such a turbulent flow enough to break a temperature boundary layer occurring on the fin. If the trapezoidal wavelike portions 96 are excessively high, a pressure loss is excessively large, and thus the heat exchange efficiency is rather lowered. The height H1 of the trapezoidal wavelike portion 96 is determined in consideration of the two conflicting conditions as described above, that is, the height H1 is required to be set so that a turbulent flow enough to break the temperature boundary layer can be produced and at the same time the resistance to the air flow can be minimized. In order to satisfy this requirement, according to this embodiment, the ratio of the height H1 of each trapezoidal wavelike portion 96 to the width W2 thereof (H1/W2) is set to ¼ to ⅕ (i.e., H1 is set to one-fourth to one-fifth of W2). Specifically, the height H1 of the trapezoidal wavelike portion 96 is preferably set to 0.3 to 0.8 mm because it could experimentally provide the highest heat exchange efficiency, and more preferably it is set to 0.6 mm.

Since the width W2 of each trapezoidal wavelike portion 96 is set to 4.1445 mm as described above, the dimensional ratio (H1/W2) of the height H1 to the width W2 is set to about ⅕.

The crest and trough of each trapezoidal wavelike portion 96 may be rounded to facilitate the manufacturing process of the fins.

The operation of the air conditioner using the heat exchanger according to this embodiment is identical to that of the first embodiment, and the detailed description thereof is omitted.

In cooling or heating operation, the air is heat-exchanged with the refrigerant passing in the refrigerant pipe by the indoor heat exchanger 7 while blown through the indoor heat exchanger 7 by a fan. In this embodiment, the air is heatexchanged while passing through the gaps between the multilayered fin members 91.

The air passing through the gaps between the fin members 91 forms a turbulent flow having such strength that the temperature boundary layer of air can be broken, but the pressure loss is not so large, so that a high heat exchange efficiency can be obtained to enhance the air conditioning power of the air conditioner.

Particularly when HFC-based refrigerant is used as refrigerant, the refrigerant circuit is kept in a high-pressure and high-temperature state. However, even in such a severe condition, each of the indoor air and the outside air can be sufficiently heat-exchanged by the heat exchanger.

Further, the crest portion of the trapezoidal wavelike portion 96 and the trough portion between the trapezoidal wavelike portions 96 are designed in the flat shape, so that the fin members 96 drain more sufficiently than the second embodiment, and thus it is more hardly frosted.

According to this embodiment, since the two trapezoidal wavelike portions and the flat portion are formed along the air flow direction on the fin of the heat exchanger, a turbulent flow enough to break the temperature boundary layer can be formed, resulting in enhancement of the heat exchange efficiency. In addition, the turbulent flow thus formed does not excessively increase its resistance to the air flow, and thus the pressure loss is not increased. Therefore, the heat exchange efficiency of the whole heat exchanger can be enhanced.

Further, the crest portion of the trapezoidal wavelike portion 96 and the trough portion between the trapezoidal wavelike portions 96 are designed in the flat shape, so that the fin members 96 drain well and thus it is hardly frosted.

According to this embodiment, the width of the fin is set to two to three times of the pipe diameter of the refrigerant pipe, the width of the flat portion is set to a half of the width of the trapezoidal wavelike portion, and the height of the trapezoidal wavelike portion is set to one-fourth to one-fifth of the width of the trapezoidal wavelike portion, whereby the heat exchange efficiency based on the temperature difference between the air and the fin in the heat exchange operation can be maximized, and at the same time the fin width can be minimized.

Furthermore, according to this embodiment, the heat exchanger as described above is used in an air conditioner. Therefore, an air conditioner having a high heat exchange efficiency can be provided, and the air-conditioning power can be enhanced. In addition, high-temperature HFC-based refrigerant can be used as refrigerant particularly in the air conditioner as described above.

In the embodiments as described above, the present invention is applied to the air conditioner. However, the present invention is applicable to other types of machines, for example, a refrigerating machine such as a refrigerator or the like.

What is claimed is:

1. A heat exchanger comprising:

a number of multilayered fins; and a refrigerant pipe inserted in said multilayered fins in a meandering form, and having a preselected diameter, wherein:

said heat exchanger performs heat exchange between air and refrigerant to perform at least one of cooling and heating operations;

each of said fins having a width of two to three times said preselected pipe diameter;

each of said fins has a corrugated portion formed in an air-flow direction thereon; and said corrugated portion has three wavelike portions for producing a turbulent flow of air with which a temperature boundary layer of the air is broken, but resistance against air flow is minimized, said three wavelike portions being formed in the air flow direction on each of said fins and each of said three wavelike portions having a substantially triangular section, a width set by substantially trisectioning said fin and a height set to one-seventh to one-eighth of the width of said wavelike portion.

2. An air conditioner in which refrigerant is circulated in a refrigerant circuit comprising a compressor, a user-side heat exchanger, an expansion device and a heat-source side heat exchanger, wherein at least one of said user-side heat exchanger and said heat-source side heat exchanger comprises:

a number of multilayered fins; and a refrigerant pipe inserted in said multilayered fins in a meandering form, and having a preselected diameter, wherein:

each of said fins has a width two to three times said preselected pipe diameter;

each of said fins has a corrugated portion formed in an air-flow direction thereon; and each said corrugated portion has three wavelike portions for producing a turbulent flow of air with which a temperature boundary layer of the air is broken, but resistance against air flow is minimized, said three wavelike portions being formed in the air flow direction on each of said fins and each of said wavelike portions having a substantially triangular section, a width set by substantially trisectioning the fin width and a height set to one-seventh to one-eighth of the width of said wavelike portion.

* * * * *